US006862820B2

(12) United States Patent
Farys et al.

(10) Patent No.: US 6,862,820 B2
(45) Date of Patent: Mar. 8, 2005

(54) FOOTWEAR ARTICLE HAVING AN ELASTIC TIGHTENING

(75) Inventors: Yves Farys, Saint-Jorioz (FR); Anne Pascal Beneteau, Annecy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/364,456

(22) Filed: Feb. 12, 2003

(65) Prior Publication Data

US 2003/0159312 A1 Aug. 28, 2003

(30) Foreign Application Priority Data

Feb. 28, 2002 (FR) ..... 02 02729

(51) Int. Cl.[7] ..... A43B 11/00
(52) U.S. Cl. ..... 36/51; 36/45
(58) Field of Search ..... 36/45, 50.5, 51, 36/50.1, 57

(56) References Cited

U.S. PATENT DOCUMENTS 4,535,554 A * 8/1985 De Obaldia B. ..... 36/113
5,023,982 A * 6/1991 Mehan ..... 24/715.3
5,117,567 A * 6/1992 Berger ..... 36/50.1
5,692,320 A * 12/1997 Nichols ..... 36/51
5,737,854 A * 4/1998 Sussmann ..... 36/50.1
5,797,200 A 8/1998 Hess et al. ..... 36/97
6,029,376 A * 2/2000 Cass ..... 36/50.1
6,195,914 B1 3/2001 Otis ..... 36/11.5
2002/0078597 A1 * 6/2002 Burt ..... 36/51

FOREIGN PATENT DOCUMENTS

| | | |
|---|---|---|
| DE | 9214715 | 3/1994 |
| FR | 1522438 | 4/1968 |
| WO | WO99/37176 | 7/1999 |

* cited by examiner

*Primary Examiner*—Ted Kavanaugh
(74) *Attorney, Agent, or Firm*—Greenblum & Bernstein, P.L.C.

(57) ABSTRACT

An article of footwear including a sole and having a low upper that is at least partially elastic, with an instep portion provided with an elastic tightening system extending from the top of the instep to the area of the sole. The elastic tightening system has a central portion extending over the top of the instep and a series of branches extending radially from the central portion to the area of the sole. Additionally, the elastic tightening system has a branch extending toward the heel on at least a lateral and medial side of the footwear article, and a branch extending toward the toes on at least a lateral and medial side of the footwear article.

35 Claims, 4 Drawing Sheets

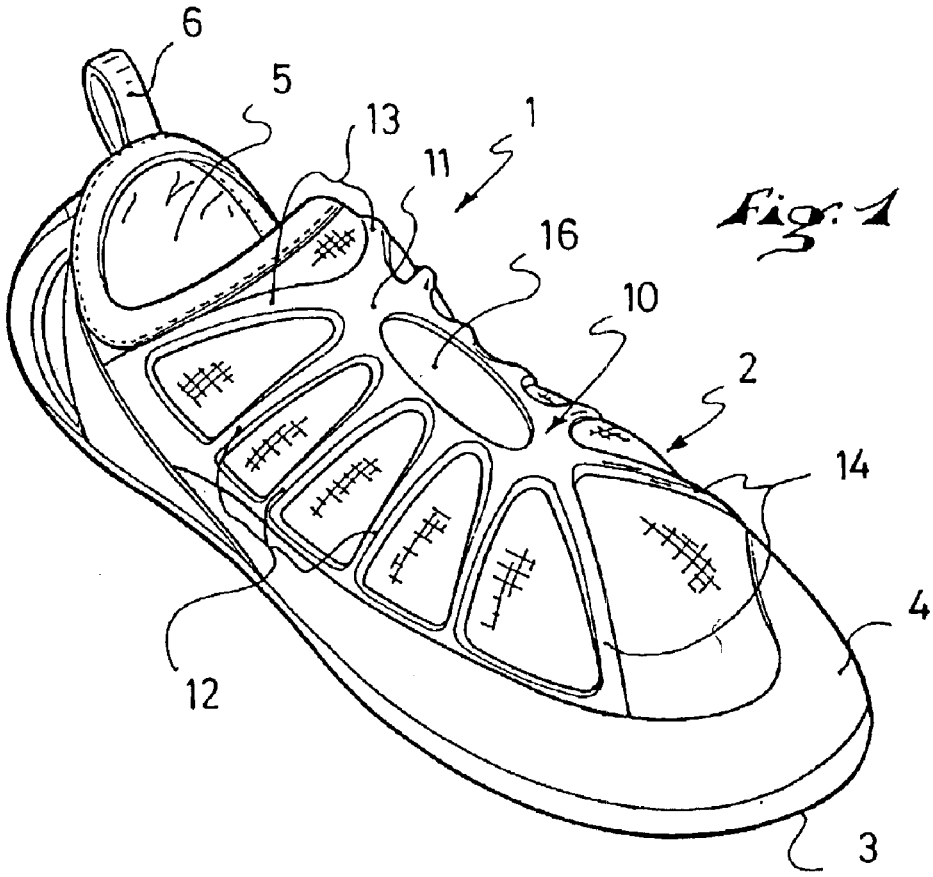
Fig. 1
Fig. 2
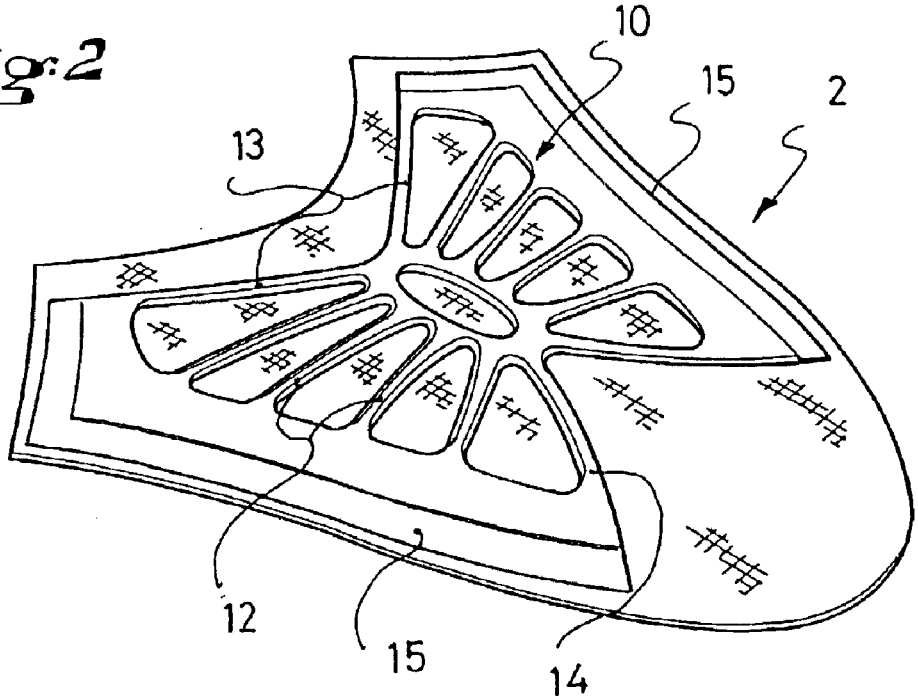

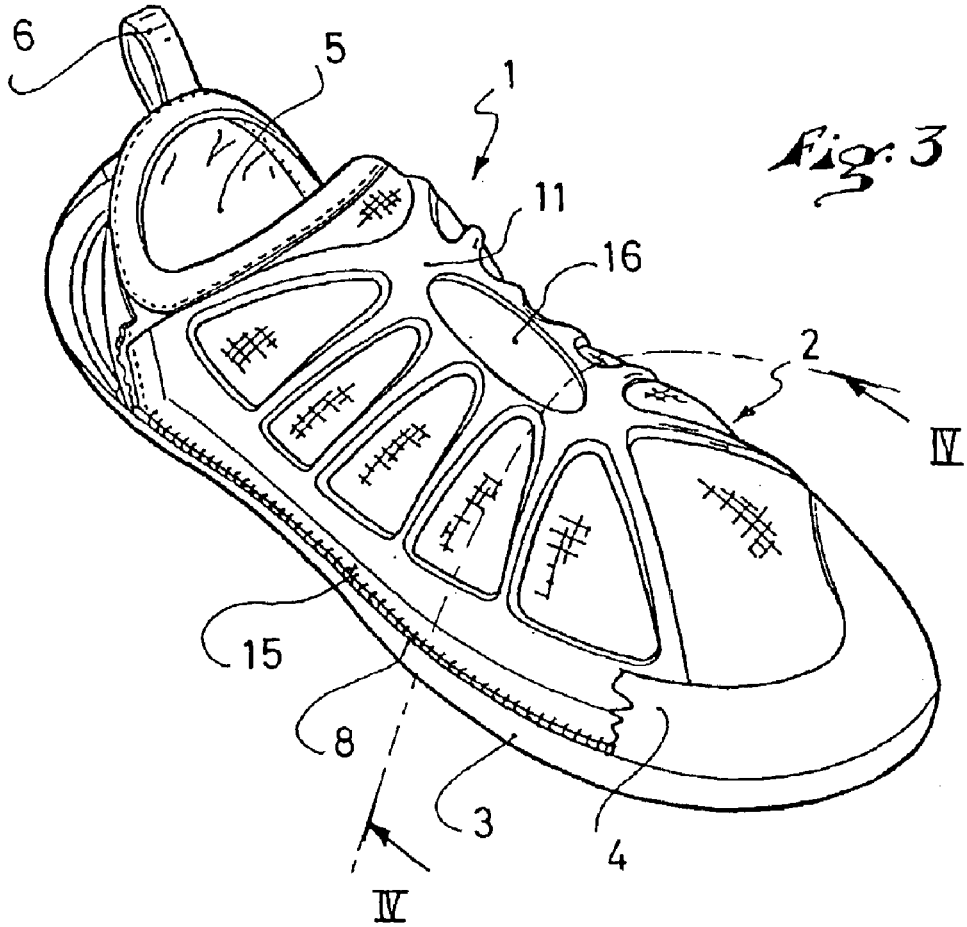
Fig. 3
Fig. 4
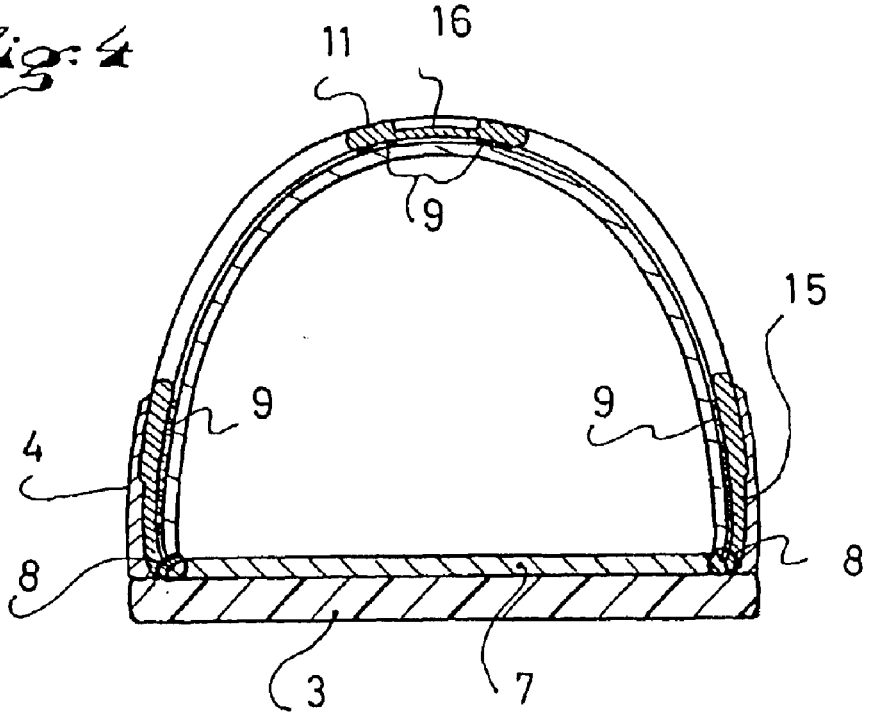

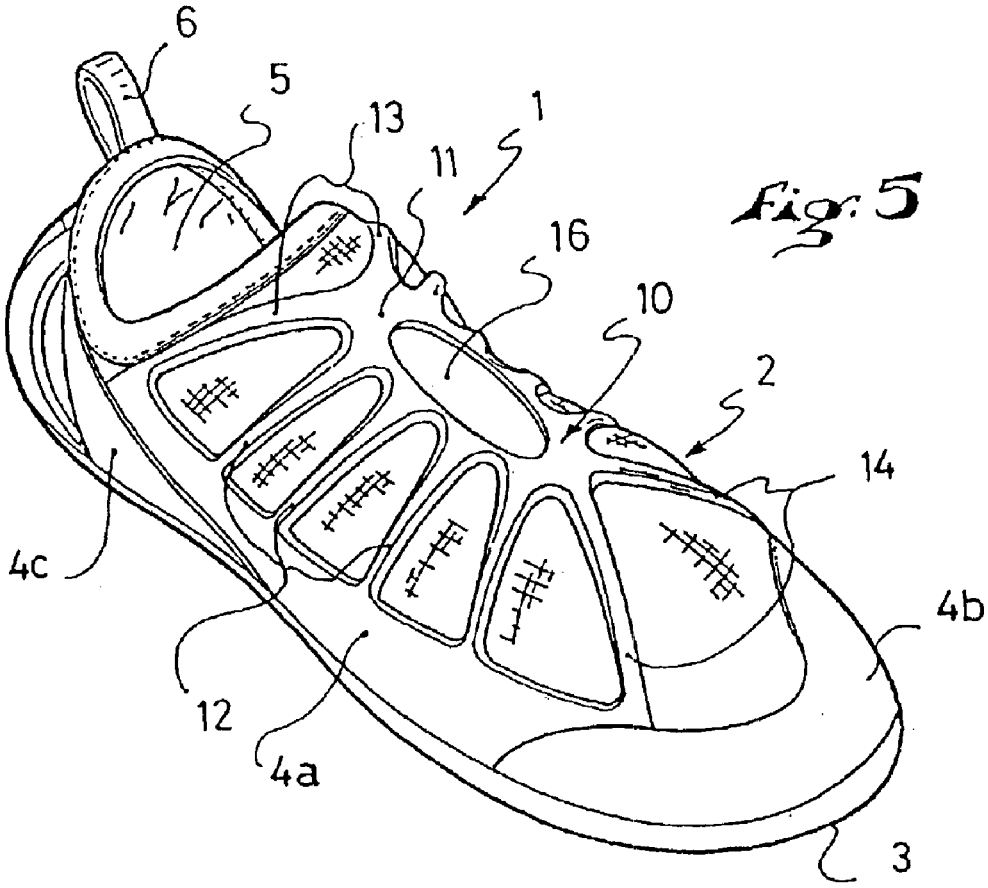
Fig. 5
Fig. 6
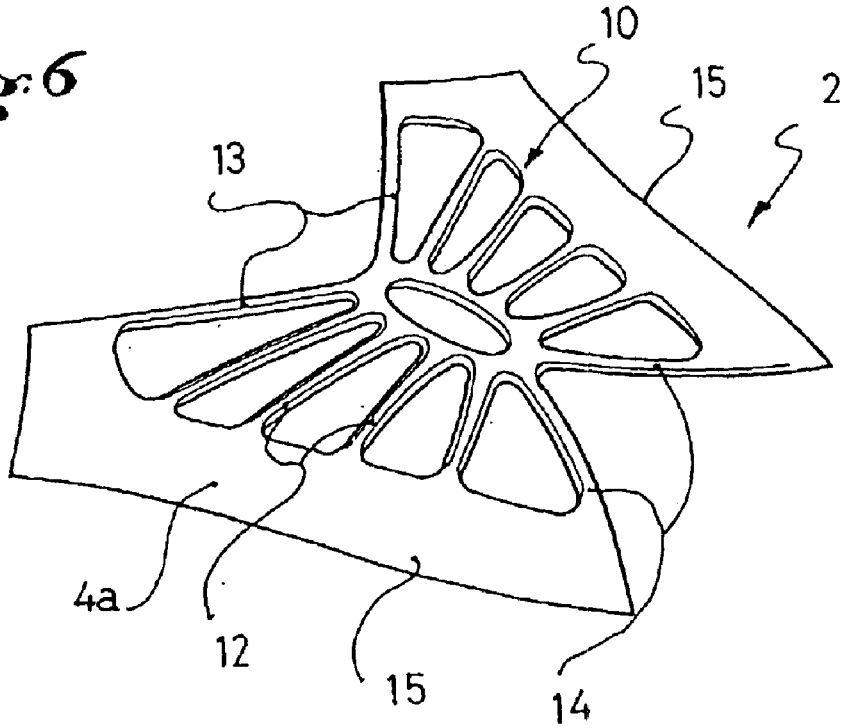

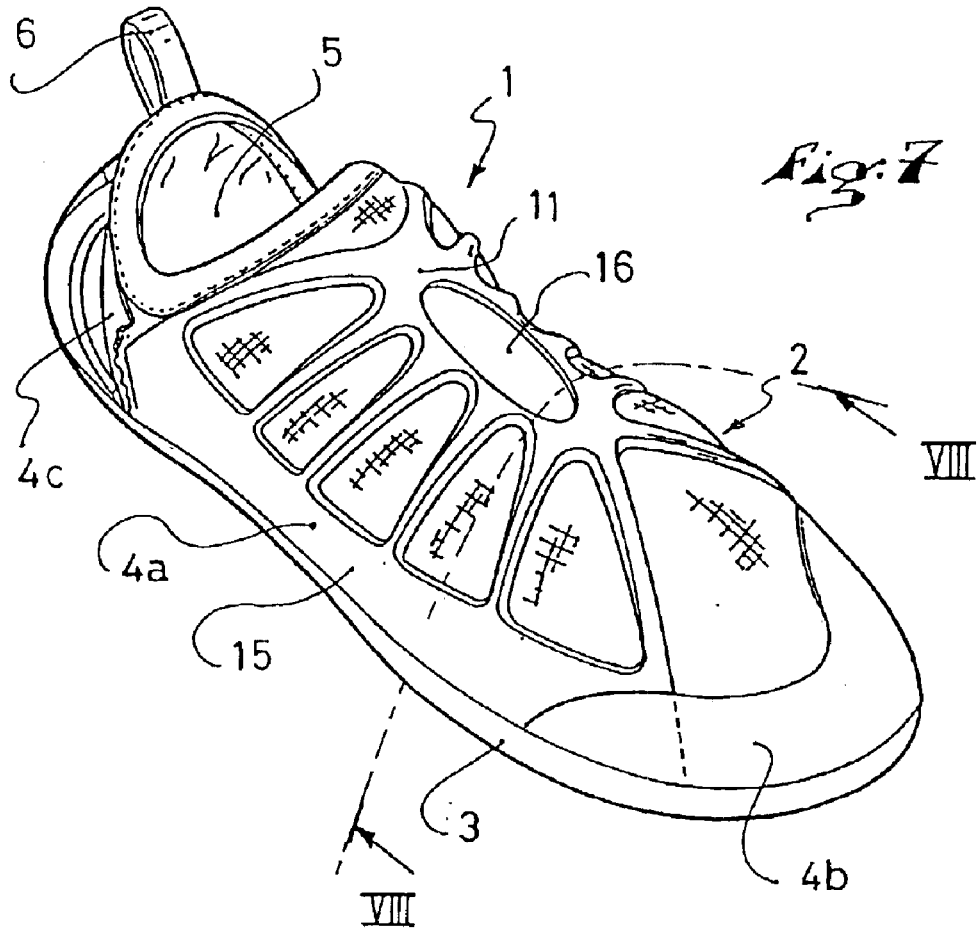
Fig: 7
Fig: 8
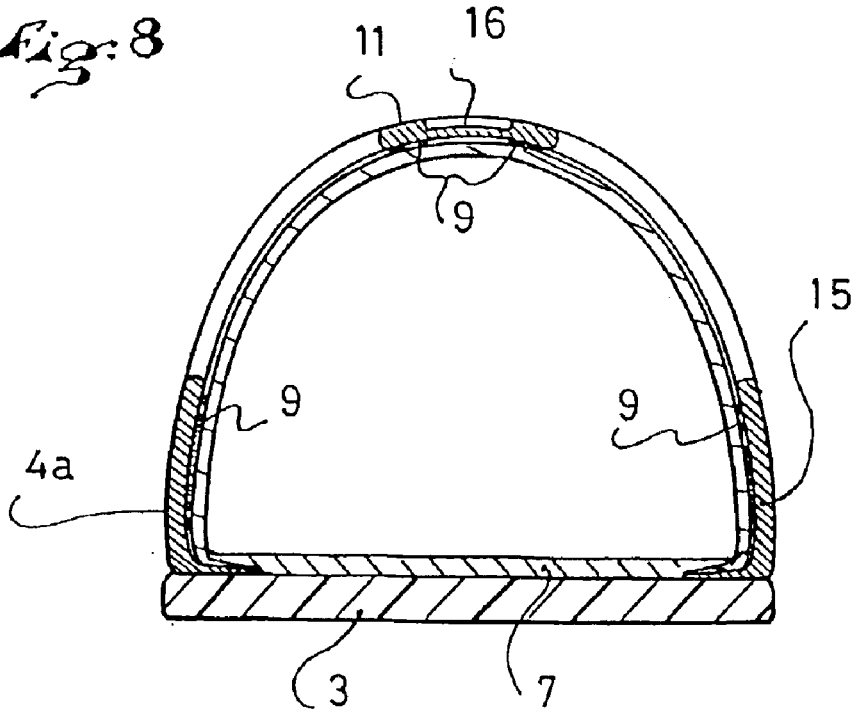

FOOTWEAR ARTICLE HAVING AN ELASTIC TIGHTENING

CROSS-REFERENCE TO RELATED APPLICATION

This application is based upon French Patent Application No. 02.02729, filed Feb. 28, 2002, the disclosure of which is hereby incorporated by reference thereto in its entirety, and the priority of which is hereby claimed under 35 U.S.C. §119.

BACKGROUND OF THE INVENTION

1. Field of the Invention

The present invention relates to an article of footwear, particularly of the shoe type, designed more particularly for sporting activities, such as climbing, dancing, water sports, fighting sports, etc.

2. Description of Background and Relevant Information

Articles of footwear of the foregoing type must be lightweight and flexible while ensuring a complete hold of the foot and a perfect mobility of the ankle.

Climbing shoes in particular are generally constituted of a rubber sole and a low upper that stops below the malleoli.

Depending upon the desired effect, the shoe is more or less flexible, the rigidity, among other things, being conferred by the more or less thick sole.

Tightening the shoe on the foot so that it assumes the shape of the foot is important for a good feel, contact, and maximum perceptions, i.e., sensory feed-back, regardless of the type of sport practiced.

Generally speaking, this tightening is obtained by conventional means, such as a lace or a tightening strap running along a zigzag path over the top of the foot, simple tightening straps provided with self-gripping means, even a simple upper provided with elastic bands in the area of the instep and/or at the top of the upper for ballerina type shoes, for which one desires a maximum lightness and wishes to avoid risks of untimely loosenings due to the use of laces or straps with self-gripping means.

In this last type of construction, the foot stability is in fact ensured mainly by the material of the upper, the elastic bands serving primarily to facilitate the fitting, and secondarily to hold the foot. Furthermore, the tightening is not always very uniform.

SUMMARY OF THE INVENTION

The present invention provides for an article of footwear, of the shoe type, that allows a tightening and an improved hold of the foot while being as lightweight as possible.

Further, the article of footwear according to the invention is of the type having a sole and a low upper that is at least partially elastic. Further, the upper of the article of footwear according to the invention is provided on its instep portion with an elastic tightening system extending from the top of the instep to the sole area. Thus, the elastic tightening system extends almost over the entire volume of the foot and allows an improved tightening that is regular and uniform, and which further improves the proprioceptive sensations.

In addition, it avoids the drawbacks due to systems, such as laces or straps, with self-gripping means that always risk coming undone. Finally, this tightening system reconciles efficiency and lightness.

BRIEF DESCRIPTION OF DRAWINGS

The invention will be better understood and other features thereof will become apparent from the following description, with reference to the attached schematic drawings showing, by way of non-limiting example, two preferred embodiments, in which;

FIG. 1 is a perspective view of a climbing shoe according to the invention;

FIG. 2 is a top view of the upper 1 of the shoe before assembly;

FIG. 3 is a view similar to FIG. 1 with a cut-away in the area of the strapping;

FIG. 4 is a cross-sectional view along the line IV—IV of FIG. 3;

FIG. 5 is a view, similar to FIG. 1, of a shoe according to a second embodiment;

FIG. 6 is a top view of the tightening system of FIG. 5,

FIG. 7 is a view similar to FIG. 5 with a cut-away in the area of the strapping;

FIG. 8 is a cross-sectional view along the line VIII—VIII of FIG. 7.

DETAILED DESCRIPTION OF THE INVENTION

The various figures of the drawing show the application of the invention to an article of footwear of the climbing shoe type. The invention can also be applied to any article of footwear of the shoe type for which similar or identical drawbacks must be resolved.

In particular, it can be applied to shoes provided for water sports, fighting sports, dancing, etc.

As shown in FIG. 1, the article of footwear or shoe 1 mainly has a closed low upper 2, provided with an upper opening 5 and with a pull tab 6 for fitting the shoe, an outer sole 3, and an elastic tightening system 10.

The upper 2 is low, meaning that it extends below the malleoli so as not to hinder the ankle articulation. As the case may be, the upper 2 could also be mid-high, i.e, covering the malleoli without nevertheless hindering the mobility of the ankle.

This upper 2 is preferably made of a completely elastic yet lightweight material, such as LYCRA® or neoprene.

The elastic tightening system 10 is composed of a central portion 11 extending over the top of the instep and substantially over the entire length thereof, and of a series of branches 12, 13, 14 extending radially from the central portion 11 to the area of the sole 3 of the shoe.

As shown more particularly in FIG. 2, the lower ends of each of the branches 12, 13, 14 are connected together by a semi-peripheral edge 15, or border, on the lateral and medial sides of the shoe.

Furthermore, the tightening system preferably has, on the lateral and medial sides of the shoe, a rear branch 13 extending toward the heel and a front branch 14 extending toward the toes. As the case may be, the branches 13, 14 can be provided only on one side. The tightening system is made of an elastic material, such as rubber.

Thus, the tightening system 11, 12, 13, 14 constitutes a type of elastic "cage" that completely envelops the foot from the area of the instep toward the heel and toes, and allows exerting a tightening force that is improved, uniform, and equally distributed over the entire foot. Further, central portion, or instep portion, 11, together with the branches 12, 13, 14, form a continuous connection from the medial side of the shoe to the lateral side of the shoe.

Also, such an equally distributed tightening force allows proprioceptive sensations that are further reinforced by the use of an upper made of elastic material(s).

Preferably, the central portion 11 of the tightening system has a hollow, or recessed, portion, or even a hole 16, in the junction zone of the branches 12, 13, 14 to improve the deformability of the assembly and not create an overpressure in this area.

The branches 12, 13, 14 can be symmetrical or asymmetrical, depending upon the desired effect, and in view of a better adaptation to the foot anatomy.

According to a preferred embodiment, the elastic tightening system 10 is affixed to the upper 2. This affixing can be done by any known means 9, such as gluing, sealing, duplicate molding, or stitching. It can be affixed only at its central portion 11 and lower portion 15 in the area of the sole, or over its entire surface, each branch 12, 13, 14 then being affixed to the upper.

FIG. 2 shows a preferred manufacturing method in which the elastic tightening system 10 is affixed flat to a precut form of the upper 2. The upper 2 is then shaped in a known manner by a stroebel stitching assembly 8 to an insole 7 and is glued to the outer sole 3. The assembly is then finalized through the positioning/securing of a strapping 4, i.e., a band of rubber or the like surrounding the lower portion of the upper 2 in the area of its junction with the outer sole 3.

In this embodiment, the tightening system 10 can be made of rubber co-molded directly to the upper 2. The assembly can also be made by a high frequency sealing. This construction offers the advantage that transparent rubber can be used for the tightening system 10 since the assembly is done without glue.

Another possibility includes assembling the tightening system 10 to the upper 2 by gluing, after assembling the latter to the sole 3 and before positioning the strapping 4.

In any case, the tightening system 10 defines a fitting volume that is less than that of the foot to be received, so as to truly exert an elastic tightening force toward the foot when the foot is positioned in the shoe.

Advantageously, tightening systems 10 that define various fitting volumes can be used for shoes having the same size, in order to take into account the morphological differences, particularly of high or low insteps, of different users' feet.

FIGS. 5–8 show a second embodiment in which the elastic tightening system 10 also constitutes a strapping portion, and in which similar or identical elements are indicated by identical numeral references.

In this embodiment, the footwear article or shoe 1 also includes an upper 2, preferably low, made of an elastic material, provided with an upper opening 5 and a pull tab 6 for fitting the shoe, an outer sole 3 and an elastic tightening system 10.

As previously, the elastic tightening system 10 comprises a central portion 11 extending over the top of the instep and a series of branches 12, 13, 14 extending radially from the central portion 11.

A primary difference with respect to the embodiment of FIGS. 1–4 resides in the fact that the peripheral edge 15 connecting the various branches 12, 13, 14 is much wider and, as a result, can extend to the lasting allowance between the upper 2 and the sole 3, then defining a portion 4*a* of the strapping.

In this type of construction, the tightening system 10 is necessarily applied to the upper 2 once the latter is assembled to the insole 7.

Indeed, once the upper 2 is assembled and shaped, the tightening system 10 is positioned on the upper end of the upper and affixed thereto, particularly by gluing, in the area of its central portion 11, then it is folded at its lower edge 15 under the insole 7 before the outer sole 3 is positioned and assembled by gluing.

As a result, the tightening system 10 is maintained by its central portion 11, on the one hand, and by its lower edge 15 affixed through lasting allowance between the insole 7 and the outer sole 3, on the other hand.

Therefore, the lower edge 15 also constitutes the lateral and medial strapping of the shoe, generating a definite reduction in weight.

If necessary, the shoe is finished with an application of two rubber strips, respectively front 4*b* and rear 4*c*, that finalize the strapping 4.

The present invention is not limited to the particular embodiments, which have been previously described by way of non-limiting examples, but it encompasses all similar or equivalent embodiments.

What is claimed is:

1. An article of footwear comprising:

a low upper, said low upper being at least partially elastic and including a portion extending at least transversely over an instep area through a longitudinal vertical median plane of the article of footwear;

a sole;

an elastic tightening system comprising an elastic material extending through the longitudinal median plane of the article of footwear and extending continuously from the instep area to an area of the sole.

2. An article of footwear according to claim 1, wherein the elastic tightening system comprises a central portion extending over the instep through the longitudinal median plane and a series of branches extending radially from the central portion to the area of the sole.

3. An article of footwear according to claim 2, wherein the central portion and the branches of the elastic tightening system form a unitary element.

4. An article of footwear according to claim 1, wherein the elastic tightening system comprises at least one branch extending toward a heel portion on a lateral side of the article of footwear and at least one branch extending toward the heel portion on a medial side of the article of footwear.

5. An article of footwear according to claim 1, wherein the elastic tightening system comprises at least one branch extending toward a toe portion on a lateral side of the article of footwear and at least one branch extending toward the toe portion on a medial side of the article of footwear.

6. An article of footwear according to claim 1, wherein the elastic tightening system is made of rubber.

7. An article of footwear according to claim 1, wherein the upper is made of an elastic material.

8. A method of manufacturing the article of footwear according to claim 1, said method comprising:

affixing the elastic tightening system flat to a precut form of the upper;

shaping and assembling the upper;

gluing the outer sole to the shaped and assembled upper.

9. An article of footwear according to claim 1, wherein the elastic tightening system comprises no lace.

10. An article of footwear comprising:

a low upper, said low upper being at least partially elastic and including a portion extending at least transversely over an instep area through a longitudinal vertical median plane of the article of footwear;

a sole;

an elastic tightening system comprising an elastic material extending through the longitudinal median plane of the article of footwear and from the instep area to an area of the sole;

the elastic tightening system comprising a central portion extending over the instep through the longitudinal median plane and a series of branches extending radially from the central portion to the area of the sole, each of said branches including a respective lower end; and a lower border, the lower ends of each of said branches being connected to the lower border.

11. An article of footwear according to claim 1, wherein the elastic tightening system is affixed to the upper.

12. An article of footwear according to claim 11, wherein the elastic tightening system is affixed to the upper in the area of a central portion of the upper and in the area of the sole.

13. An article of footwear according to claim 12, wherein the elastic tightening system includes a plurality of branches affixed to the upper.

14. An article of footwear according to claim 10, wherein the border constitutes a portion of strapping for protecting the upper.

15. An article of footwear comprising:

a low upper, said low upper being at least partially elastic and including a portion extending at least transversely over an instep area through a longitudinal vertical median plane of the article of footwear;

a sole;

an elastic tightening system comprising an elastic material extending through the longitudinal median plane of the article of footwear and from the instep area to an area of the sole;

a strapping extending along at least a part of a lower periphery of the upper, the elastic tightening system comprising portions on medial and lateral sides of the upper, the strapping being non-adjustably fixed to said portions of the elastic tightening system.

16. An article of footwear according to claim 15, wherein the upper comprises a portion adapted to extend over a foot of a wearer at least from an instep of the wearer to and including an entirety of the wearer's toes.

17. An article of footwear comprising:

a low upper, said low upper being at least partially elastic and including a portion extending at least transversely over an instep area through a longitudinal vertical median plane of the article of footwear;

a sole;

an elastic tightening system comprising an elastic material extending through the longitudinal median plane of the article of footwear and from the instep area to an area of the sole;

the elastic tightening system comprising a central portion extending over the instep through the longitudinal median plane and a series of branches extending radially from the central portion to the area of the sole;

the central portion and the branches of the elastic tightening system being made of the same elastic material.

18. An article of footwear according to claim 17, wherein at least the central portion of the elastic tightening system is permanently affixed to the upper.

19. An article of footwear comprising:

a low upper, said low upper being at least partially elastic and including a portion extending at least transversely over an instep area through a longitudinal vertical median plane of the article of footwear;

a sole;

an elastic tightening system comprising an elastic material extending through the longitudinal median plane of the article of footwear and from the instep area to an area of the sole;

the elastic tightening system comprising a central portion extending over the instep through the longitudinal median plane and a series of branches extending radially from the central portion to the area of the sole;

the central portion and the branches of the elastic tightening system forming a unitary element;

at least the central portion of the elastic tightening system is permanently affixed to the upper.

20. A climbing shoe comprising:

a sole;

an upper fixed to the sole, the upper comprising an elastic material adapted to stretch upon insertion of a foot within the shoe, the upper fixed to the sole at least along a continuous peripheral extent along a medial side of the shoe, along a front of the shoe, and along a lateral side of the shoe;

a tightening system comprising:

an instep portion adapted to be positioned over an instep of a foot of a wearer when the foot of the wearer is within the shoe;

a lower medial portion and a lower lateral portion, the lower medial and lateral portions being fixed relative to the sole;

a plurality of medial branches connecting the instep portion to the lower medial portion, and a plurality of lateral branches connecting the instep portion to the lower lateral portion;

at least the instep portion and the pluralities of medial and lateral branches comprising a continuous connection from the medial side of the shoe to the lateral side of the shoe.

21. A climbing shoe according to claim 20, wherein:

the instep portion, the lower medial and lateral portions, and the pluralities of medial and lateral branches comprise a single material.

22. A climbing shoe according to claim 20, wherein:

the lower medial and lateral portions of the tightening system comprise respective borders fixed to the sole.

23. A climbing shoe according to claim 20, wherein:

the instep portion, the lower medial and lateral portions, and the pluralities of medial and lateral branches are comprised of a single elastic material.

24. A climbing shoe according to claim 20, wherein:

the instep portion, the lower medial and lateral portions, and the pluralities of medial and lateral branches are comprised a single rubber material.

25. A climbing shoe according to claim 20, wherein:

the elastic tightening system comprises no lace.

26. A climbing shoe according to claim 20, wherein:

the upper comprises a portion adapted to envelop a foot of a wearer at least from an instep of the wearer to and including an entirety of the wearer's toes.

27. An article of footwear according to claim 20, wherein:

the tightening system overlies the upper and the upper is visible between the medial and lateral branches of the tightening system.

28. An article of footwear comprising:

a sole;

an upper fixed to the sole, the upper comprising an elastic material adapted to stretch upon insertion of a foot within the shoe, the upper fixed to the sole at least along a continuous peripheral extent along a medial side of the shoe, along a front of the shoe, and along a lateral side of the shoe;

a tightening system comprising:

an instep portion adapted to be positioned over an instep of a foot of a wearer when the foot of the wearer is within the shoe;

a lower medial portion and a lower lateral portion, the lower medial and lateral portions being fixed relative to the sole;

a plurality of medial branches connecting the instep portion to the lower medial portion, and a plurality of lateral branches connecting the instep portion to the lower lateral portion;

at least the instep portion and the pluralities of medial and lateral branches comprising a continuous connection from the medial side of the shoe to the lateral side of the shoe.

29. An article of footwear according to claim 28, wherein:

the instep portion, the lower medial and lateral portions, and the pluralities of medial and lateral branches comprise a single material.

30. An article of footwear according to claim 28, wherein:

the lower medial and lateral portions of the tightening system comprise respective borders fixed to the sole.

31. An article of footwear according to claim 28, wherein:

the instep portion, the lower medial and lateral portions, and the pluralities of medial and lateral branches are comprised of a single elastic material.

32. An article of footwear according to claim 28, wherein:

the instep portion, the lower medial and lateral portions, and the pluralities of medial and lateral branches are comprised a single rubber material.

33. An article of footwear according to claim 28, wherein:

the elastic tightening system comprises no lace.

34. An article of footwear according to claim 28, wherein:

the upper comprises a portion adapted to envelop a foot of a wearer at least from an instep of the wearer to and including an entirety of the wearer's toes.

35. An article of footwear according to claim 28, wherein:

the tightening system overlies the upper and the upper is visible between the medial and lateral branches of the tightening system.

* * * * *